US011268256B2

(12) United States Patent
Sanders et al.

(10) Patent No.: US 11,268,256 B2
(45) Date of Patent: Mar. 8, 2022

(54) CULVERT SYSTEM WITH FLEXIBLE TOE WALL

(71) Applicant: CONTECH ENGINEERED SOLUTIONS LLC, West Chester, OH (US)

(72) Inventors: Darrell J. Sanders, Mason, OH (US); Brian N. Flint, Mason, OH (US)

(73) Assignee: CONTECH ENGINEERED SOLUTIONS LLC, West Chester, OH (US)

( * ) Notice: Subject to any disclaimer, the term of this patent is extended or adjusted under 35 U.S.C. 154(b) by 0 days.

(21) Appl. No.: 17/001,866

(22) Filed: Aug. 25, 2020

(65) Prior Publication Data

US 2021/0062452 A1 Mar. 4, 2021

Related U.S. Application Data

(60) Provisional application No. 62/891,550, filed on Aug. 26, 2019.

(51) Int. Cl.

| | |
|---|---|
| ***E02D 29/02*** | (2006.01) |
| ***E02D 17/20*** | (2006.01) |
| ***E01F 5/00*** | (2006.01) |

(52) U.S. Cl.

CPC ..... *E02D 29/0225* (2013.01); *E01F 5/005* (2013.01); *E02D 17/202* (2013.01)

(58) Field of Classification Search

CPC ..... E01F 5/005; E02B 11/005; E02D 29/0225

USPC ..... 405/124, 125, 127

See application file for complete search history.

(56) References Cited

U.S. PATENT DOCUMENTS

| | | | | |
|---|---|---|---|---|
| 1,620,089 | A * | 3/1927 | Fischer | E01F 5/005 405/125 |
| 1,935,273 | A * | 11/1933 | Lane | E01F 5/005 138/106 |
| 2,343,029 | A * | 2/1944 | Schmidt | E01F 5/005 138/106 |
| 4,723,871 | A * | 2/1988 | Roscoe | E01F 5/005 405/124 |
| 5,277,520 | A | 1/1994 | Travis | |
| 6,394,700 | B1 * | 5/2002 | Fish | E01F 5/00 138/96 R |
| 6,533,498 | B1 | 3/2003 | Quin | |
| 6,612,779 | B1 * | 9/2003 | Scuero | E02D 17/18 405/107 |
| 7,645,098 | B1 | 1/2010 | Rainey | |
| 10,285,340 | B2 | 5/2019 | Manning | |
| 2012/0020745 | A1 | 1/2012 | Miller | |
| 2019/0145068 | A1 | 5/2019 | Zock | |

FOREIGN PATENT DOCUMENTS

| | | | |
|---|---|---|---|
| JP | 2002167754 | * | 6/2002 |
| WO | WO 2017/079661 | * | 5/2017 |

* cited by examiner

*Primary Examiner* — Sean D Andrish

(74) *Attorney, Agent, or Firm* — Thompson Hine LLP

(57) ABSTRACT

A culvert system includes a flexible toe wall that connects to and extends down from the bottom of the culvert. The flexible toe wall is capable of readily conforming to various shapes of the trench conditions provided to receive the toe wall, before or as the trench is backfilled.

19 Claims, 8 Drawing Sheets

CULVERT SYSTEM WITH FLEXIBLE TOE WALL

TECHNICAL FIELD

The present application relates to the general art of structural, bridge and geotechnical engineering, and to the particular field of toe walls for culverts with full inverts.

BACKGROUND

Culverts of various types are known, such as culverts formed of corrugated metal plate, culverts formed by metal pipe and culverts of precast and/or cast in place concrete. Toe walls are used at the inlet and outlet ends of such culverts to prevent inflowing water from eroding the foundation material that supports the culvert. The toe walls extend downward below the ground surface. For corrugated metal plate culverts, one option for the toe wall is formed by a rigid aluminum metal sheet that is connected to the invert or bottom of the culvert. Such an arrangement is shown in FIGS. 1 and 2 where a box culvert 10 includes a rigid metal toe wall 12 extending down from the invert (bottom wall) 14 of the culvert. In the case of concrete culverts, the toe wall may typically be formed of concrete that is cast-in-place after the culvert is positioned on site. Both options tend to be costly and are not readily adaptable to ground conditions.

In particular, and as shown in FIG. 2, the trench 16 at the installation site that is provided to receive the toe wall may not be excavated in the exact specified location, which can leave a gap or gaps 18 behind the aluminum metal toe wall 12. In addition, if a rock is found in the location of the trench, it may become necessary to cut the aluminum metal toe wall on site in order to enable the culvert to be properly installed. Similar problems can occur in the case of cast-in-place concrete toe walls, which are also time consuming and expensive from a labor and materials perspective.

Accordingly, it would be desirable to provide a culvert system with a toe wall arrangement that addresses one or more of the above constructability issues.

SUMMARY

In one aspect, a culvert system includes a flexible toe wall that connects to and extends down from the bottom of the culvert. The flexible toe wall is capable of readily conforming to various shapes of the trench conditions provided to receive the toe wall, before or as the trench is backfilled.

In another aspect, a method of installing a culvert structure involves: placing a culvert structure along a water flow path with an inlet end of the culvert structure at an upstream side of a flow direction of the water flow path; providing a trench along the inlet end of the culvert structure, the trench including a downstream side wall and an upstream side wall; placing a flexible toe wall that is connected to the inlet end of the culvert structure within the trench; and back filling a material into the trench on an upstream side of the flexible toe wall.

In another aspect, a culvert assembly includes a culvert structure defining a through passage from an inlet end to an outlet end, the culvert structure including an invert. A first flexible toe wall is located at the inlet end of the culvert structure, the first flexible toe wall extending downward from the invert. A second flexible toe wall is located at the outlet end of the culvert structure, the first flexible toe wall extending downward from the invert.

The details of one or more embodiments are set forth in the accompanying drawings and the description below. Other features, objects, and advantages will be apparent from the description and drawings, and from the claims.

DETAILED DESCRIPTION

Figure 3:
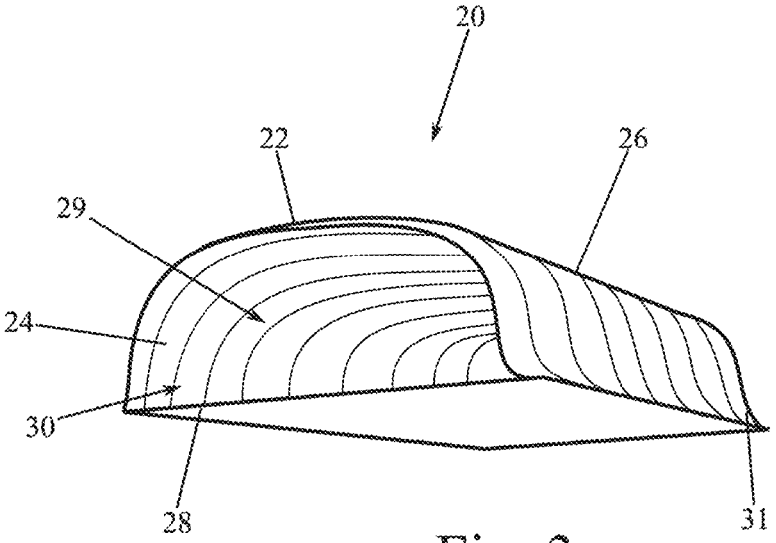
FIG. 3 is a perspective view of an exemplary corrugated metal box culvert.
Figure 1:
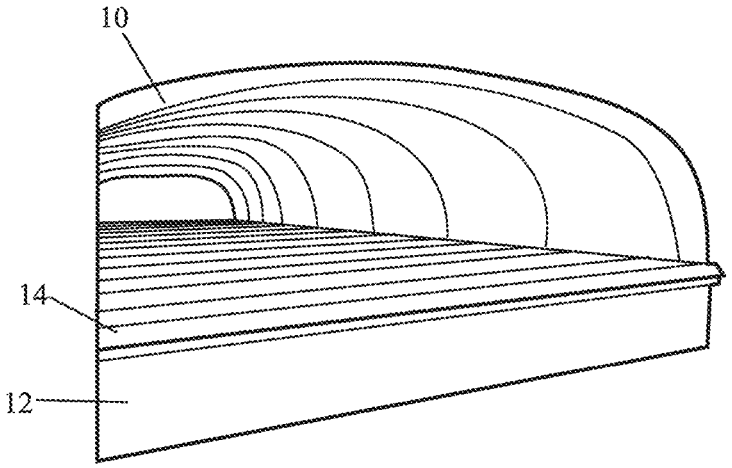
Fig. 1 (Prior Art)
FIG. 1 is a perspective view of a prior art corrugated metal box culvert with a rigid metal toe wall.
Figure 2:
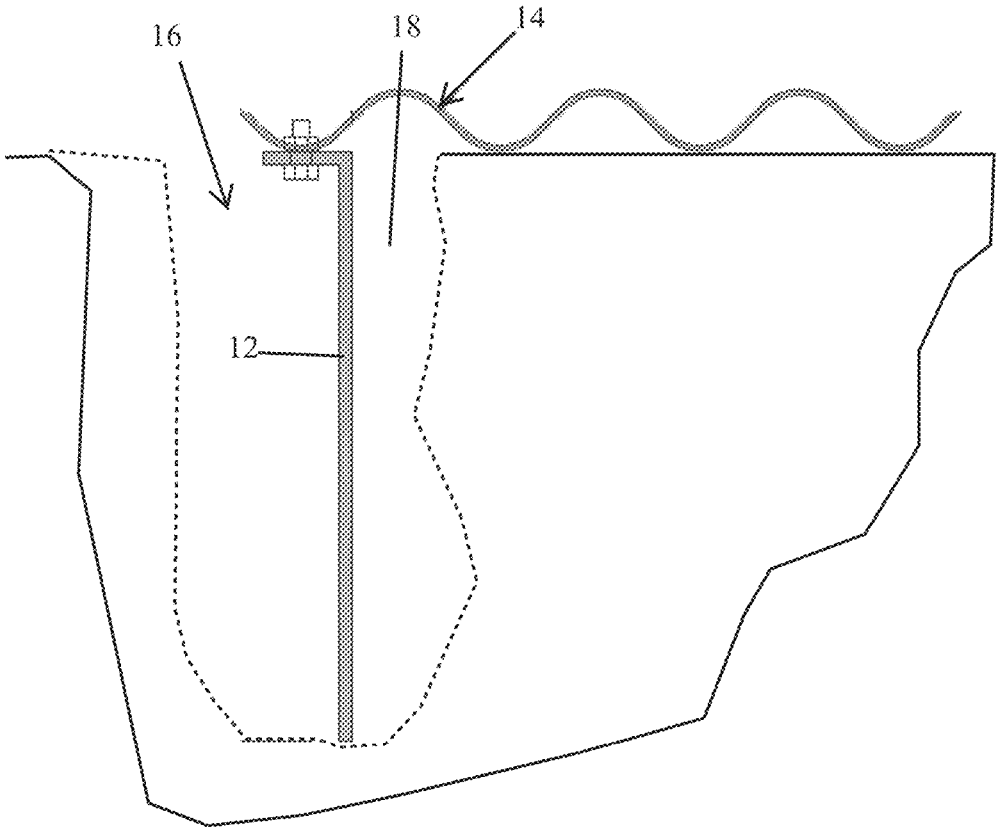
Fig. 2 (Prior Art)
FIG. 2 is a schematic partial side view of the prior art box culvert and rigid metal toe wall of FIG. 1.

Referring to FIG. 3, a metal box culvert 20 includes a top wall or crown 22 and side walls 24, 26 extending down to a bottom wall or invert 28 of the culvert to define a through tunnel or passage 29 from an inlet end 30 to an outlet end 31. The inlet end and outlet end are defined by the relative positioning of the ends directionally along a water flow path at the installation site. The metal plate is of corrugated form for increased structural integrity and may include reinforcement ribs in some applications. Various shapes of such culverts are known, and the exact shape of the culvert is not a limiting factor. The side walls and top wall of the culvert may typically be buried or otherwise covered at the installation site, with the inlet and outlet ends exposed to allow water flow through the passage 29.

The following description focuses on a flexible toe wall placed at the inlet end of a culvert. However, the description should be understood to apply equally to a flexible toe wall placed at the outlet end of a culvert. The depictions show in the figures are also representative of flexible toe walls placed at the outlet end of a culvert.

Figure 5:
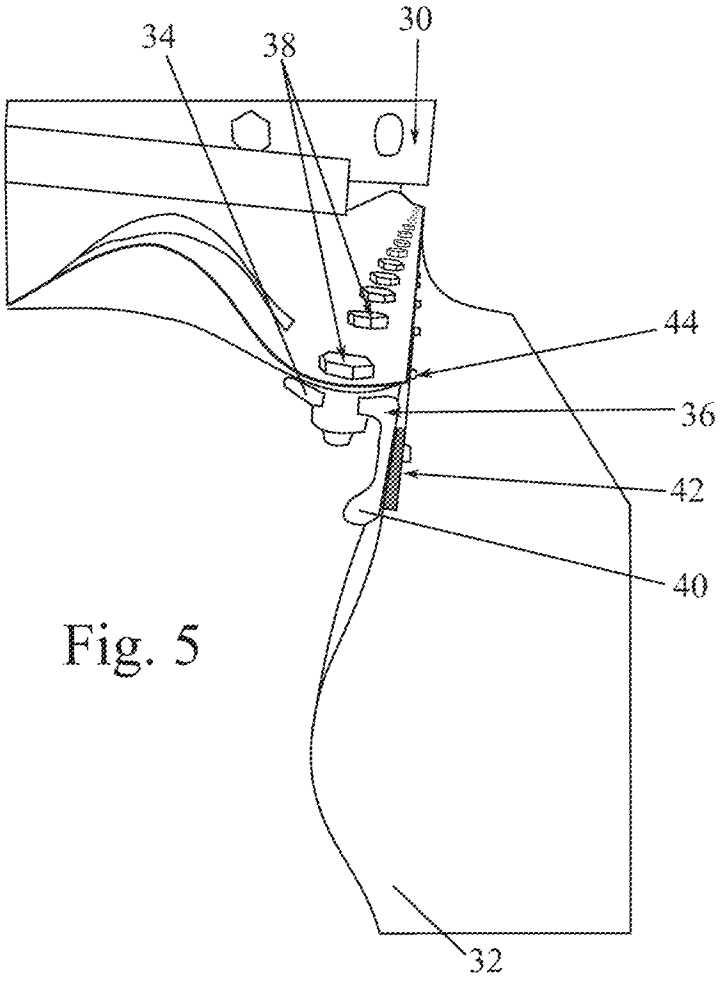
FIGS. 4-6 show partial perspective views of a metal box culvert with attached polymer toe wall.
Figure 4:
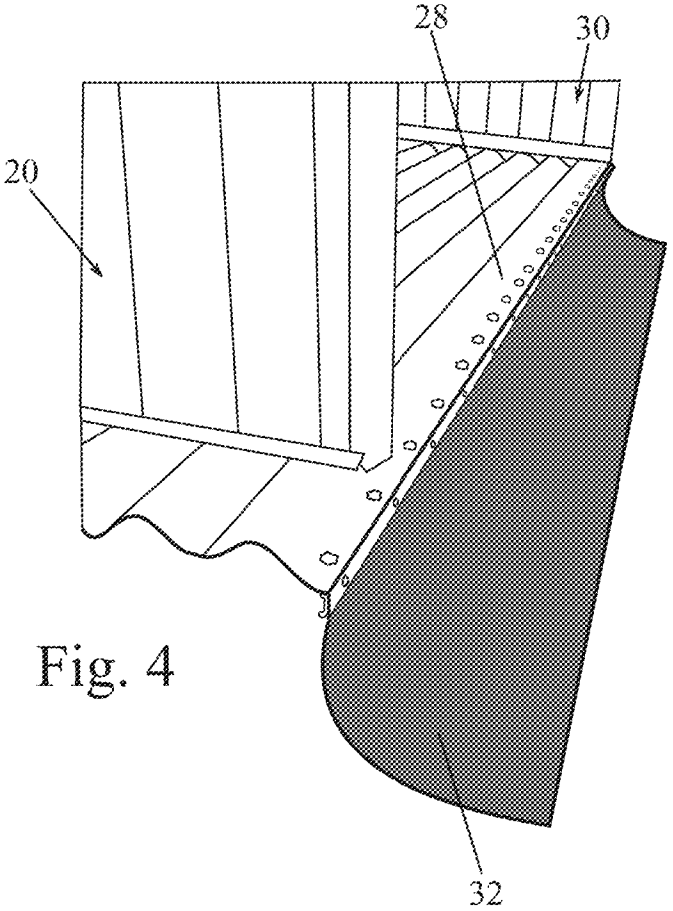
Figure 6:
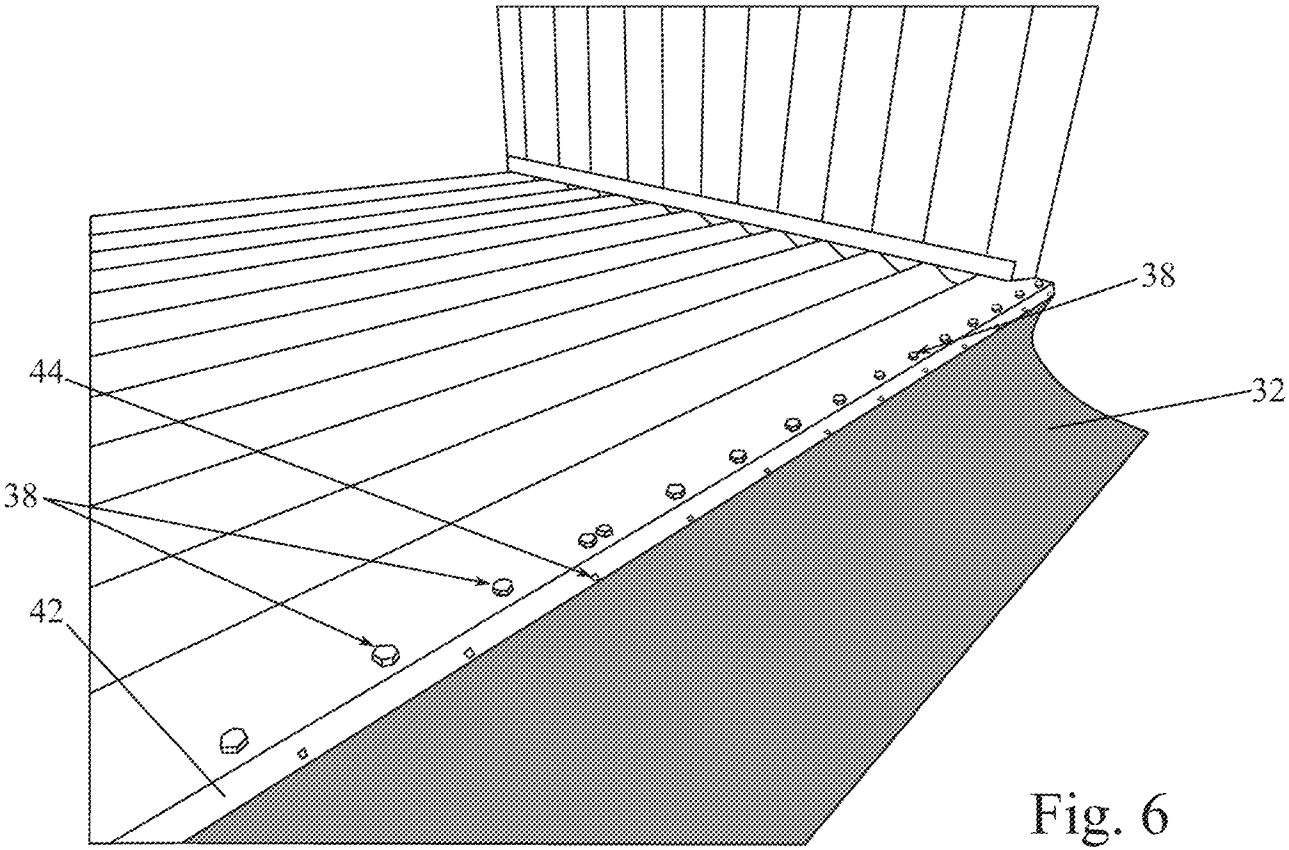

FIGS. 4, 5 and 6 show the inlet end 30 of the culvert 20, with a flexible toe wall 32 connected proximate the inlet end edge of the invert 28. Here, a rib 36 and mount plate 42 are used to connect the flexible toe wall 32 to the culvert, with the exemplary rib being an L-shaped rib and the exemplary mount plate being a flat plate. One leg 34 of the L-shaped rib 36 is connected at the bottom side of the inlet end edge of the invert (e.g., by a series of nut and bolt assemblies 38). The leg 34 may have a slight curvature to mate with the plate curvature at the inlet end edge for this purpose. The upper edge of the flexible toe wall 32 is mounted to the downwardly extending leg 40 of the L-shaped rib. In particular, the flat plate 42 is attached to the front side of the leg 40 by a series of bolts or screws 44, with the upper end edge of the toe wall 32 sandwiched and held tightly between the leg 40 and the mount plate 42. The bolts or screws 44 may pass through openings in the flexible toe wall material as well. In addition, part of the upper end edge of the toe wall material is also sandwiched and held tightly between the upper surface of the leg 34 and the bottom surface of the culvert invert.

By way of example, the flexible toe wall 32 may be of a water impermeable polymer sheet material, such as high-density polyethylene. However, any other suitable flexible and water impermeable material, such as other plastic liners, could be used. In advantageous implementations, the flexible polymer sheet material has a thickness of 60 mil or higher. The size and spacing of the bolts/screws 38, 44 may vary. The downward extending depth of the toe wall sheet (i.e., the depth that the toe wall sheet can hang down from the invert) can also vary. Depths on the order of 18" to 48", such as 30" to 36", are likely, but other depths can be used. The rib and mount plate that are used to attach the toe wall to the invert of the box culvert structure may both be aluminum, although they could be made from alternate materials.

Notably, the flexible polymer toe wall can flex forwardly and/or rearwardly of the inlet end edge of the culvert 20 as needed, with possible variations in the direction of flex or lay across the width of the inlet end of the culvert. The flexible toe wall 32 also can readily lay even when a rock is present in the trench that is excavated on-site to receive the toe wall. The flexible nature of the toe wall is advantageous because it more readily adapts to the shape of a trench that is produced at the inlet end of the culvert in order to receive the toe wall, before or as backfill material is placed in front of the toe wall.

Figure 7:
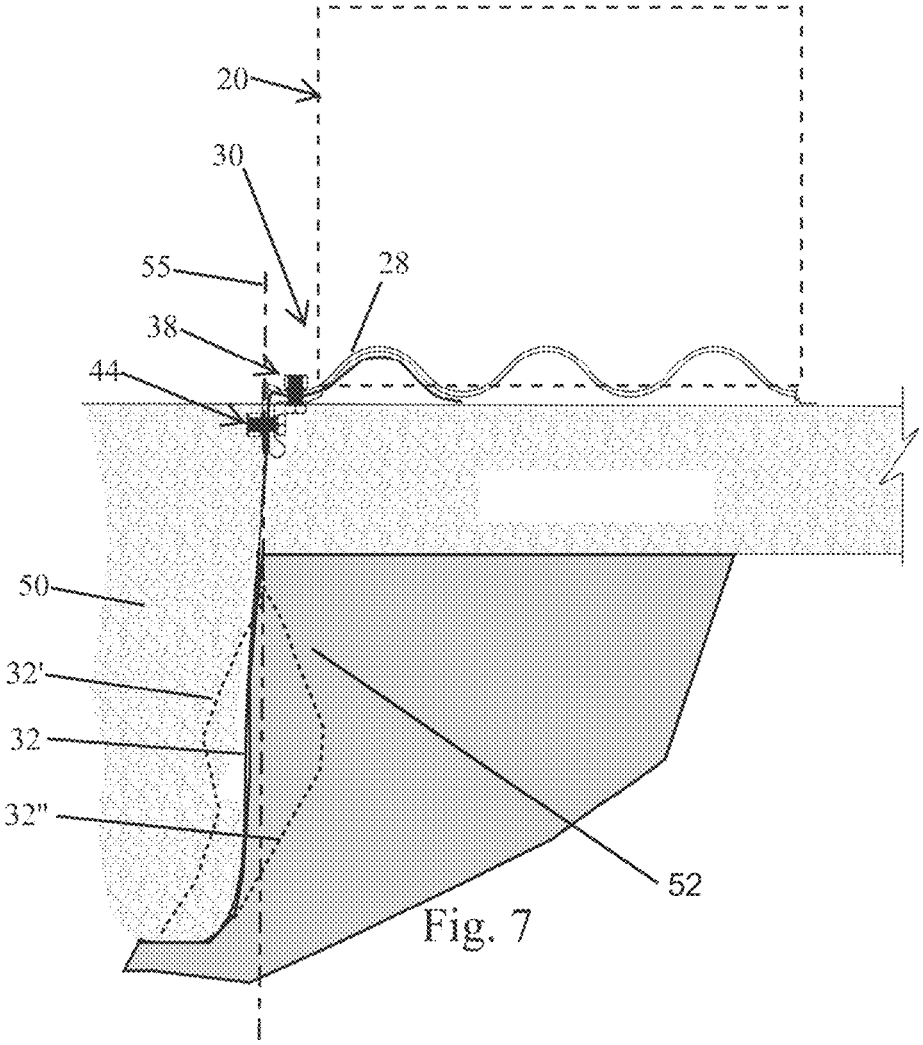
FIG. 7 shows a schematic side elevation of the flexible polymer toe wall connected to the invert of the metal culvert.

In this regard, FIG. 7 shows an exemplary side elevation with the flexible toe wall 32 against the earthen material after back fill 50 is added in front of the toe wall 32. The outward facing surface (facing out away from the through passage of the culvert, here the left facing surface) of the toe wall 32 is engaged by the back fill 50, and the inward facing surface (facing inward toward the through passage of the culvert, here the right facing surface) of the toe wall lies against the earthen material 52 (e.g., typically undisturbed material) into which the trench to receive the toe wall has been excavated. However, other possible positions for the flexible toe wall, based on conforming to different variations in the trench of the site, are demonstrated by dashed line forms 32' and 32".

A flexible toe wall can also be incorporated into a precast concrete box culvert. For example, the upper edge of the toe wall could be positioned in the form system so as to be embedded in the concrete when it cures. Alternatively, a bolt on assembly could be provided into the input/output edge of the bottom wall of the precast concreted box culvert.

As explained above, regardless of the material from which the box culvert is formed, a flexible toe wall will readily conform to better match the trench wall that is excavated at the installation site. Such a trench is cut/dug in the existing ground either before or after the structure is in place. In either case, the wall of the excavation is rarely perfectly vertical or in direct alignment with the location where the toe wall is to be attached to the invert of the structure. With a rigid system of the prior art, this means that voids commonly exist in the area behind the toe wall, which is undesirable. The described flexible system will conform to match the trench wall behind it as backfill material is placed and compacted in front of the toe wall. This minimizes or eliminates any voids in this area, which voids, if present, can cause the needed structural backfill around the structure to be displaced in the voids, potentially jeopardizing the integrity of the toe wall. In other words, the flexible toe wall material will take on a non-planar configuration to match both the ground material behind the toe wall (i.e., on the downstream side, or inward facing side, of the toe wall) and the backfill ground material forward of the toe wall. In this arrangement, for some installations, some portions of the flexible toe wall may be behind a mount plane of the flexible toe wall and some portions may be forward of the mount plane, where the mount plane is defined by a vertical plane running through the location at which the flexible toe wall connects to the culvert structure (e.g., see plane 55 in FIG. 7).

When a trench is being excavated to accommodate a toe wall, it is not uncommon that a rock or a layer of rock is encountered which impedes the proper excavation of the trench. In these cases, with a rigid toe wall of the prior art, the toe wall plate either has to be field modified in order to accommodate the obstruction in the trench. This modification can be difficult to perform and frequently requires specialized tools that may not be readily available on a job site. With the described flexible toe wall, the toe wall material can be allowed to drape over the obstruction or can be easily field cut with a common utility knife to accommodate the obstruction.

In some instances, the flexible toe wall can be attached and folded over the lip of the culvert invert prior to the structure being lifted into the trench. This technique simplifies the attachment of the toe wall as compared to the conventional rigid system.

The described flexible toe wall, regardless of material of the box culvert structure, provides an advantageous culvert installation method. In particular, a method of installing a box culvert structure involves: placing a box culvert structure along a water flow path with an inlet end of the box culvert structure at the upstream side of a flow direction of the water flow path; providing a trench along the inlet end of the box culvert structure, the trench including a downstream side wall and an upstream side wall; placing a flexible toe wall that is connected to the inlet end of the box culvert structure within the trench; and back filling a material into the trench on an upstream side of the flexible toe wall causing the flexible toe wall to be pushed into conformity with a shape of the downstream side wall of the trench. Likewise, for the outlet end, a method of installing a box culvert structure involves: placing a box culvert structure along a water flow path with an outlet end of the box culvert structure at the downstream side of a flow direction of the water flow path; providing a trench along the outlet end of the box culvert structure, the trench including a downstream side wall and an upstream side wall; placing a flexible toe wall that is connected to the outlet end of the box culvert structure within the trench; and back filling a material into the trench on a downstream side of the flexible toe wall causing the flexible toe wall to be pushed into conformity with a shape of the upstream side wall of the trench.

Figure 8:
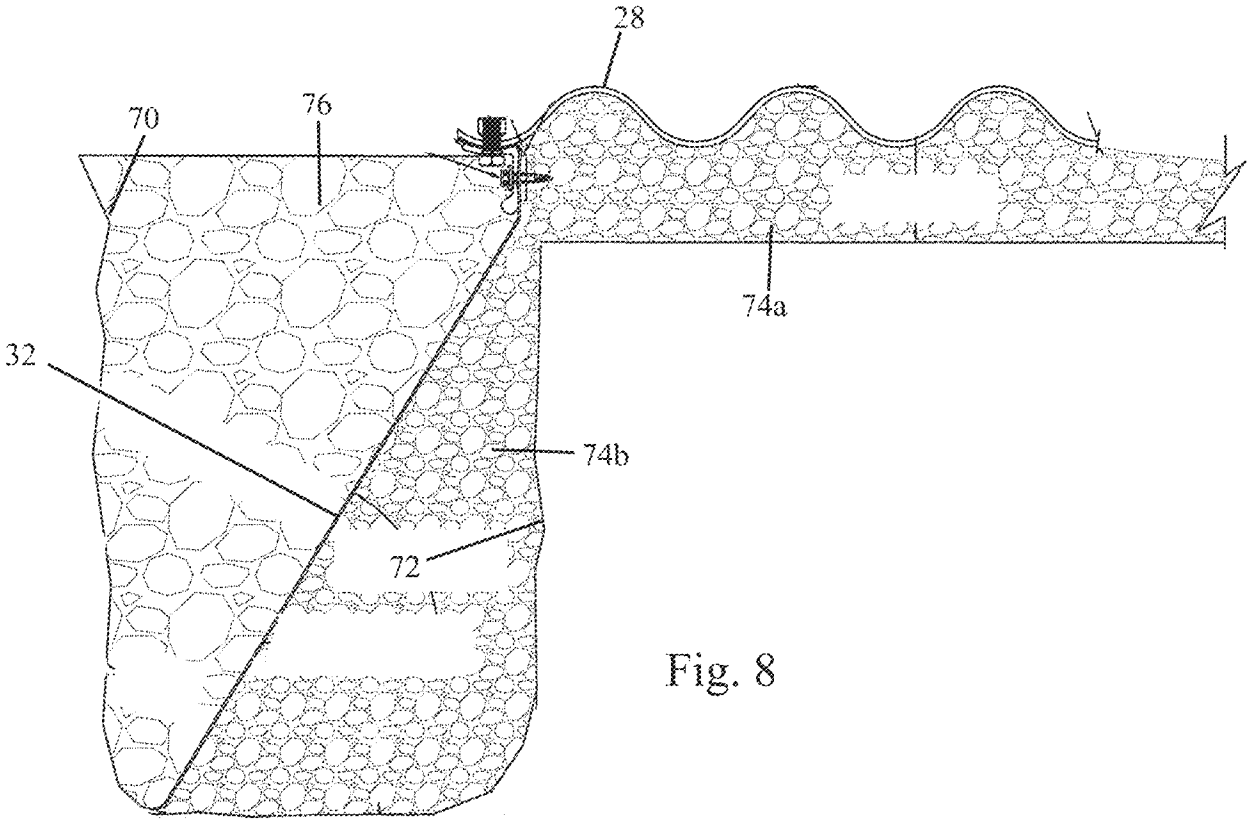
FIG. 8 shows another schematic side elevation of part of an installed culvert with a flexible toe wall.
Figure 9:
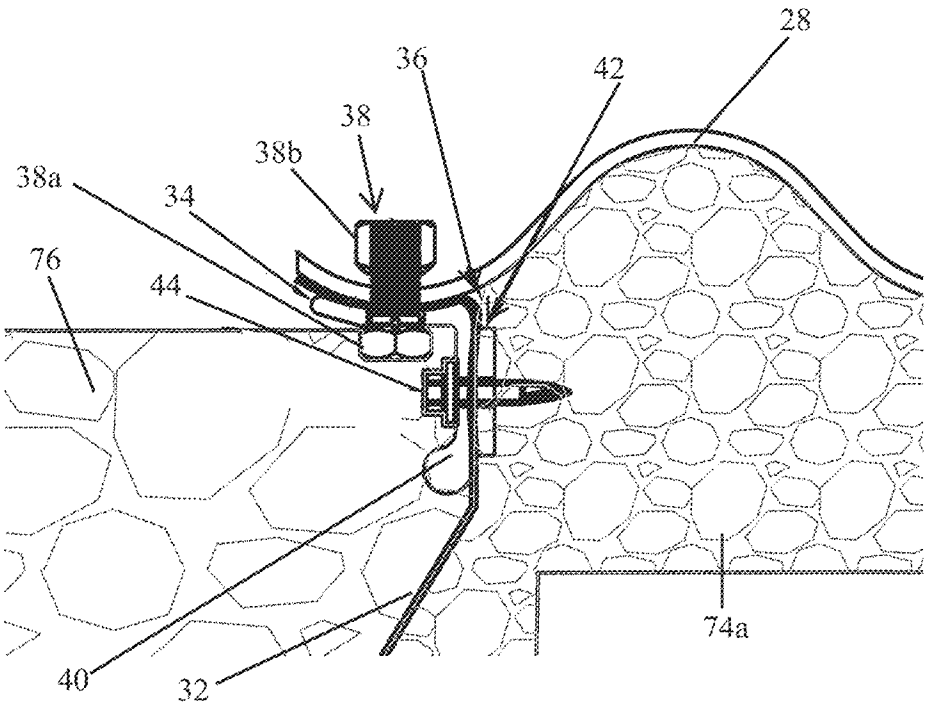
FIG. 9 shows an enlarged view of part of FIG. 8.

Referring to FIGS. 8 and 9, another inlet end installed embodiment is shown in which the outward facing wall or face 70 of the trench and the inward facing wall or face 72 of the trench are both shown. The trench is initially excavated. Then, bedding material 74*a* (e.g., stone) is placed to support the culvert and some bedding material 74*b* is also placed in the trench to form an intentional outwardly sloped (extending both down and toward the upstream direction in the case of the inlet end) face against which the toe wall 32 will be placed. The invert 28 of the culvert is then placed on the bedding material 74*a*, and the toe wall 32 is placed to overlie the bedding material 74*b*. Backfill 76 is then placed in the trench so that the toe wall 32 is captured between the backfill 76 and the bedding material 74*b*.

In one embodiment, the toe wall 32 is previously attached to the invert 28 before the invert is placed. In another embodiment, after the invert 28 is placed on the bedding material 74*a*, the toe wall is attached to the invert by first pre-assembling the toe wall structure.

The pre-assembling may involve, placing the flat plate 42 on a level surface, positioning the toe wall material on top of the flat plate with a set amount of material (e.g., 2" to 6") extending beyond what will be the top edge of the flat plate 42. The rib 36 is then placed on top of the fabric, with rib leg 40 sandwiching the fabric against the flat plate 42. Both ends of the flat plate and rib are then clamped together. The rib 36 is then secured to the flat plate 42 using the screws 44 (e.g., self-drilling screws). The clamps can then be removed. Bolts 38*a* are then attached to leg 34 of the rib 36 (e.g., in pre-drilled holes of the leg 34, and extending upward). The bolts 38*a* may be held in place on the leg 34 by spring clips. The toe wall assembly (toe wall 32, rib 36, and flat plate) is then connected to the invert 28 using the bolts 38*a*(e.g., the bolts 38*a* pass upward through pre-drilled holes at the edge of the invert 28 and nuts 38*b* are threaded on the bolts 38*a*). In this step, part of the fabric may also be sandwiched between the upper surface of the leg 34 and the bottom surface of the invert 28. In the embodiment of FIGS. 8 and 9, the flat plate 42 is at the downstream side of the rib 36 (opposite the orientation of FIG. 5).

Figure 10:
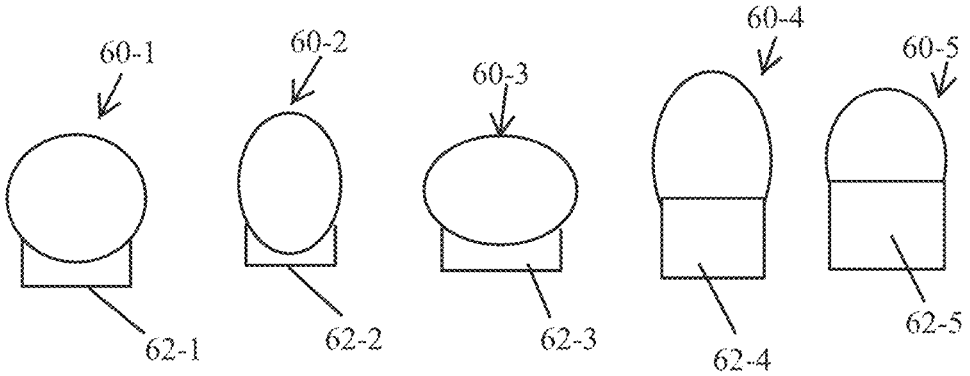
FIG. 10 shows end profiles of other possible culvert shapes.

The flexible toe wall and the method are applicable to both the inlet and outlet ends of culverts of various shapes, sizes and materials, and is not limited to box culverts. For example, the culvert shapes 60-1, 60-2, 60-3, 60-4 and 60-5 depicted in FIG. 10, all of which incorporate inverts, could also include flexible toe walls 62-1, 62-2, 62-3, 62-4 and 62-5 as shown. In such culverts, the flexible toe wall may be connected to the end of the culvert structure using a rib and mount plate curved to match the shape of the culvert structure invert, or by use of other suitable attachment arrangements.

What is claimed is:

1. A culvert system, comprising:

a culvert structure defining a through passage from an inlet end to an outlet end, the culvert structure including an invert;

a flexible toe wall connected at one of the inlet end or the outlet end of the culvert structure, the flexible toe wall extending downward from the invert, wherein the flexible toe wall is comprised of a flexible water impermeable material that is configured to change shape upon installation so as to conform to a non-planar ground material surface;

wherein the flexible water impermeable material is a polymer material.

2. The culvert system of claim 1, wherein the polymer material is a high-density polyethylene.

3. The culvert system of claim 1, wherein the polymer material has a thickness of 60 mil or higher.

4. The culvert system of claim 1, wherein the culvert structure is formed of metal plate material, and wherein the flexible toe wall is fastened to the invert of the culvert structure via an assembly comprised of a rib and a mount plate, wherein each of the rib and the mount plate run along a width of the culvert.

5. The culvert system of claim 4, wherein an upper portion of the flexible toe wall is sandwiched between the rib and the mount plate.

6. The culvert system of claim 5, wherein the rib is an L-shaped rib having a first leg secured to the invert of the culvert structure and a second leg extending downward from the invert, wherein the mount plate is secured to the second leg.

7. The culvert system of claim 6, wherein the first leg is secured to the invert by a plurality of fasteners, and the mount plate is secured to the second leg by a plurality of fasteners.

8. The culvert system of claim 1, wherein the culvert structure is located along a water flow path having an associated flow direction, wherein the inlet end of the culvert structure is located at an upstream side of the water flow path relative to the water flow direction and the outlet end of the culvert structure is located a downstream side of the water flow path relative to the flow direction, wherein the flexible toe wall is located at the inlet end and extends downward within the ground with a non-planar configuration that conforms to ground material at a downstream side of the flexible toe wall and backfill forward of the flexible toe wall.

9. The culvert system 9, wherein one or more portions of the flexible toe wall extend behind a mount plane of the flexible toe wall.

10. The culvert system of claim 8, wherein one or more portions of the flexible toe wall extend forward of the mount plane of the flexible toe wall.

11. The culvert system of claim 8, wherein one or more portions of the flexible toe wall extend behind a mount plane of the flexible toe wall and one or more portions of the flexible toe wall extend forward of the mount plane of the flexible toe wall.

12. The culvert system of claim 1, wherein the culvert structure is formed of a precast concrete material.

13. A method of installing a culvert structure, comprising:

placing a culvert structure along a water flow path with an inlet end of the culvert structure at an upstream side of a flow direction of the water flow path;

providing a trench along the inlet end of the culvert structure, the trench including a downstream side wall and an upstream side wall;

placing a flexible toe wall that is connected to the inlet end of the culvert structure within the trench, wherein the flexible toe wall is formed of a flexible polymer material;

back filling a material into the trench on an upstream side of the flexible toe wall; and the back filling causing the flexible toe wall to change shape so as to be pushed into conformity with a non-planar shape of the downstream side wall of the trench.

14. The method of claim 13, wherein the trench is created after placing of the culvert structure or before placing of the culvert structure.

15. The method of claim 13, wherein the flexible toe wall is connected to the inlet end of the culvert structure after placing of the culvert structure or before placing of the culvert structure.

16. The method of claim 13, wherein an action of the back filling material on the flexible toe wall causes the flexible toe wall to be pushed into conformity with the non-planar shape of the downstream side wall of the trench.

17. The method of claim 13, wherein prior to the back filling, a bedding material is placed in a downstream side of the trench, the bedding material forming a forwardly sloped surface, wherein the back filling causes the flexible toe wall to be pushed into conformity with the forwardly sloped surface.

18. A culvert assembly, comprising:

a culvert structure defining a through passage from an inlet end to an outlet end, the culvert structure including an invert;

a first flexible toe wall at the inlet end of the culvert structure, the first flexible toe wall extending downward from the invert and being configured to change shape upon installation so as to conform to a non-planar surface, wherein the first flexible toe wall is formed of a flexible polymer material;

a second flexible toe wall at the outlet end of the culvert structure, the first flexible toe wall extending downward from the invert and being configured to change shape upon installation so as to conform to a non-planar surface, wherein the second flexible toe wall is formed of a flexible polymer material.

19. The culvert assembly of claim 18, wherein the flexible polymer material of which the first flexible toe wall is formed is water impermeable;

the flexible polymer material of which the second flexible toe wall is formed is water impermeable;

the culvert structure is formed of metal plate material;

the first flexible toe wall is fastened to the invert of the culvert structure via an assembly comprised of a first rib and a first mount plate, wherein each of the first rib and the first mount plate run along a width of the culvert, with an upper portion of the first flexible toe wall sandwiched between the first rib and the first mount plate;

the second flexible toe wall is fastened to the invert of the culvert structure via an assembly comprised of a second rib and a second mount plate, wherein each of the second rib and the second mount plate run along the width of the culvert, with an upper portion of the second flexible toe wall sandwiched between the second rib and the second mount plate.

* * * * *